US009831057B2

(12) United States Patent
Durth

(10) Patent No.: US 9,831,057 B2
(45) Date of Patent: Nov. 28, 2017

(54) LOAD CURRENT BEARING FUSE WITH INTERNAL SWITCH ELEMENT

(71) Applicant: PHOENIX CONTACT GMBH & CO. KG, Blomberg (DE)

(72) Inventor: Rainer Durth, Horn-Bad Meinburg (DE)

(73) Assignee: PHOENIX CONTACT GMBH & CO. KG (DE)

( * ) Notice: Subject to any disclaimer, the term of this patent is extended or adjusted under 35 U.S.C. 154(b) by 0 days.

(21) Appl. No.: 15/380,586

(22) Filed: Dec. 15, 2016

(65) Prior Publication Data

US 2017/0178856 A1 Jun. 22, 2017

(30) Foreign Application Priority Data

Dec. 16, 2015 (DE) ..... 10 2015 225 377

(51) Int. Cl.
*H01H 85/02* (2006.01)
*H01H 85/055* (2006.01)
*H01H 85/048* (2006.01)
*H01H 85/44* (2006.01)

(52) U.S. Cl.
CPC ..... *H01H 85/0241* (2013.01); *H01H 85/048* (2013.01); *H01H 85/055* (2013.01); *H01H 85/44* (2013.01); *H01H 2085/0283* (2013.01)

(58) Field of Classification Search
CPC ..... H01H 85/0241; H01H 85/055; H01H 2085/0283
USPC ..... 337/295
See application file for complete search history.

(56) References Cited

U.S. PATENT DOCUMENTS 3,737,725 A 6/1973 Donnelly
6,452,475 B1 * 9/2002 Kawazu ..... H01H 85/463 29/623
6,566,995 B2 * 5/2003 Furuuchi ..... H01L 23/5256 257/E23.149
6,671,126 B2 * 12/2003 Durth ..... H01T 4/12 360/119.01
8,982,525 B2 * 3/2015 Durth ..... H01C 7/12 361/111
9,088,155 B2 * 7/2015 Durth ..... H01H 85/44
9,449,778 B2 * 9/2016 Durth ..... H01T 1/14
2012/0243138 A1 * 9/2012 Cerny ..... H02H 9/041 361/93.8

(Continued)

FOREIGN PATENT DOCUMENTS

DE 102013019391 A1 * 10/2014 ..... H01T 1/14
DE 10 2014 215 282 B3 10/2015

*Primary Examiner* — Anatoly Vortman
(74) *Attorney, Agent, or Firm* — Sheridan Ross P.C.

(57) ABSTRACT

The disclosure relates to a load current-bearing fuse with internal switch element. One example of the fuse includes a protective element with a first contact, a fuse element that connects the first contact with a second contact, and a protective element having a third contact that can be connected to a second potential of a supply network, but is electrically insulated from the fuse element. The fuse element is also disclosed to include a fluxing agent that has a lower fusion point that the fuse element itself. The fuse is further disclosed to include an internal switch element that monitors a protective element internally and can bring about a targeted disconnection.

7 Claims, 4 Drawing Sheets

(56) References Cited

U.S. PATENT DOCUMENTS

2012/0268850 A1* 10/2012 Rainer ..... H01T 1/15
361/56

* cited by examiner

LOAD CURRENT BEARING FUSE WITH INTERNAL SWITCH ELEMENT

CROSS-REFERENCE TO RELATED APPLICATIONS

This application claims the benefit of German Patent Application No. DE 102015225377.5 filed Dec. 16, 2015, the entire contents of which are incorporated herein by reference.

BACKGROUND

Electrical loads must be protected.

Different fuses are used for this purpose depending on the type of supply network and the type of load.

Particularly in direct-current networks, disconnection poses a substantial problem because, unlike in alternating-current networks, no periodic zero crossings are present, so possible switching arcs are not quenched automatically.

In the past, many types of fuses have been designed with elaborate methods for suppressing electric arcs.

Existing fuses are designed to switch in the event of an overcurrent.

However, there is increasing demand for fuse elements that can also be reliably tripped in the event of a moderate current as well.

Existing fuses switch off reliably only in the presence of greatly elevated currents. This is due to the manner in which they are tripped. Specifically, if the protection level is set too low in existing fuses, the fuse is tripped even in the event of momentary overcurrent, such as when a capacitative load is charged or at engine startup, for example. For this reason, existing fuses tend to be generously (over-)dimensioned with respect to overcurrent.

On the other hand, more and more applications are arising in which a continuous slight overload is present which, while hazardous, is not identified as overcurrent.

In networks with limited short circuits, such as PV (photovoltaic) systems, for example, in which the operating current is only about 10% below the short-circuit current, the currents are so small in the event of a short circuit that normal fuses are not tripped.

In PV and wind turbine generators, there is the added difficulty that the currents in partial-load operation (e.g., partly cloudy, moderate wind) lie so far below the maximum current of the system that a short-circuit current that occurs then lies in the range and below the rated current value of the corresponding fuse.

OBJECT OF THE INVENTION

It would therefore be desirable to provide a cost-effective load current-bearing fuse that can also enable reliable tripping in the abovementioned case.

BRIEF DESCRIPTION OF THE INVENTION

The object is achieved by a load current-bearing fuse with internal switch element. The load current-bearing fuse has a protective element, with the protective element having a first contact for connecting to a first potential of a supply network and a second contact that can be connected to a second potential of the supply network via a device to be protected. The protective element has a fuse element that connects the first contact and the second contact of the protective element, with the protective element further comprising a third contact that can be connected to the second potential of the supply network and is arranged so as to be near to but electrically insulated from the fuse element. In the area of the adjacent contact, the fuse element has a constriction, with the constriction being embodied such that the fuse element has an electrically conductive fluxing agent in the area of the constriction, with the fluxing agent having a lower fusion point than the fuse element itself. The fuse element further comprises an internal switch element that monitors the protective element internally and can bring about a targeted disconnection, with the internal switch element being a voltage-sensitive element that is connected with one contact to the first contact and that is arranged so as to be near another contact of the voltage-sensitive element but electrically insulated from the fuse element and near to but electrically insulated from the third contact.

Other advantageous embodiments of the invention are indicated in the description.

BRIEF DESCRIPTION OF THE DRAWINGS

In the following, the invention is explained in further detail with reference to the enclosed drawings on the basis of preferred embodiments.

DETAILED DESCRIPTION

Figure 1:
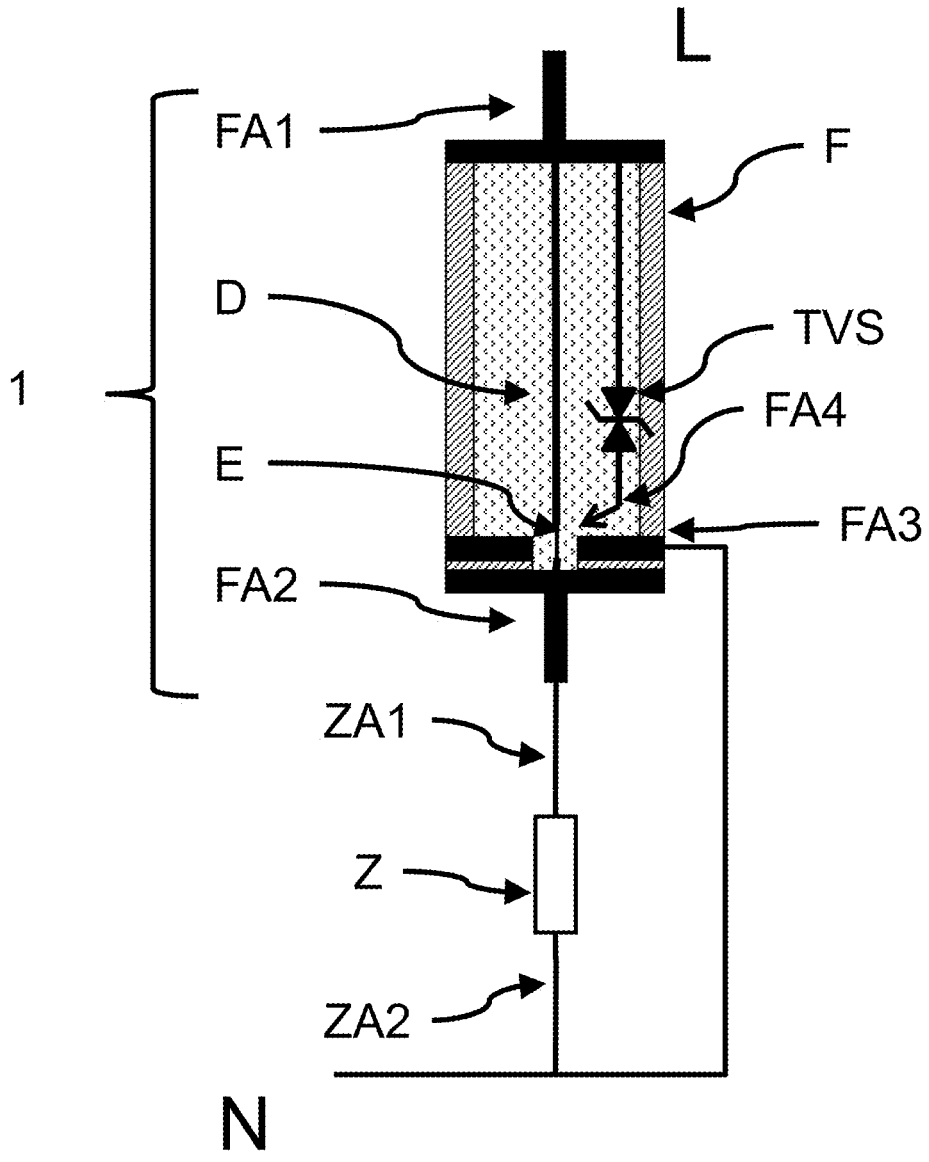
FIG. 1 shows a schematic representation of a load current-bearing fuse according to the invention with internal switch element.

The invention is explained in further detail below with reference to the figures. It should be noted that different aspects are described, each of which can be utilized individually or in combination. That is, any aspect can be used with different embodiments of the invention, provided that it is not portrayed explicitly as a mere alternative.

Moreover, for the sake of simplicity, reference will generally be made in the following to only one entity. Insofar as not noted explicitly, however, the invention can also have several of the entities concerned. Therefore, the use of the words "a," "an," "of a" and "of an" is to be understood only as an indication to the effect that at least one entity is used in a single embodiment.

Even though reference is made in the following to phases N, L of an alternating-current network, the invention is not limited to this, but can be used in any configuration of an electrical supply network, whether in the form of a direct-current network or a single-phase or multi-phase alternating-current network.

In its most general form, a load current-bearing fuse 1 according to the invention with internal switch element has a protective element F.

The protective element F has a first contact FA1 for connecting to a first potential L of a supply network and a second contact FA2 that can be connected via a device Z to be protected to a second potential N of the supply network.

Even though reference will henceforth be made in the description to a device Z to be protected, this does not necessarily refer to an electrical load. Similarly, the device to be protected could also be a power generation device, such as a wind turbine or solar power generator.

The protective element F has a fuse element D that connects the first contact FA1 and the second contact FA2 of the protective element F, with the protective element F further comprising a third contact FA3 that can be connected to the second potential N of the supply network and is arranged so as to be near to but electrically insulated from the fuse element D, with the fuse element D having a constriction E in the area of the adjacent contact FA3, with the constriction being embodied such that the fuse element D has an electrically conductive fluxing agent SM in the area of the constriction E, with the fluxing agent SM having a lower fusion point than the fuse element D itself.

The load current-bearing fuse further comprises an internal switch element that monitors the protective element internally and can bring about a targeted disconnection, with the internal switch element being a voltage-sensitive element TVS that is connected with one contact to the first contact FA1 and that is arranged so as to be near another contact FA4 of the voltage-sensitive element TVS but electrically insulated from the fuse element D and near to but electrically insulated from the third contact FA3.

Through the configuration of the constriction, the load current-bearing fuse 1 can be designed in such a way that even overcurrents of longer duration result in a reliable disconnection.

If the overcurrent is too high, such as in the case of a short circuit, then the fuse element will immediately fuse in the area of the constriction E and thus be tripped.

That is, the constriction E is overloaded thermally such that the fuse element fuses at the constriction E and an electric arc is formed which, in turn, commutates to the third contact FA3 provided in the proximity of the constriction E, so that the device Z to be protected is electrically discharged, the current quenched and the device Z to be protected disconnected from the network. The device Z to be protected is thereby released from the arc integral of the protective element F. Upon release, the device Z is disconnected from the network in a securely insulated manner.

In the second case of overload, the level of the overloading of the device Z to be protected moves within a range in which the device Z to be protected is not directly destroyed but an alteration of its electrical characteristics can be expected.

To this end, the fuse element D has an electrically conductive fluxing agent SM in the proximity of the constriction. The electrically conductive fluxing agent SM diffuses into the fuse element upon heating and reduces its conductivity. Since the electrically conductive fluxing agent SM is arranged in the proximity of the constriction, due to the fact that greater electrical resistance is now present here, commensurately faster heating can be expected.

This technique enables improved triggering of the protective element F. Through appropriate dimensioning, selection of material, and geometry of the constriction as well as the targeted influence of temperature exposure time, the aging process of the constriction E can be appropriately adjusted.

That is, the aging of the constriction E can be used in a targeted manner for the purpose of tripping the fuse in the case of small overcurrents of long duration.

On the other hand, the internal switch element TVS also provides another possibility for triggering. In this option, the voltage across the fuse element D is evaluated. This enables an inference to be made regarding the current flowing through the fuse element D. If the voltage has reached the characteristic voltage for the switching of the voltage-sensitive element TVS, ignition occurs in the area of the constriction E analogously to the case of overcurrent.

In other words, the switching point can be influenced, as above, through the appropriate selection of the switching voltage. Even overcurrents that will not have resulted in tripping in conventional fuse elements can thus be used for switching.

In this way, the protection level can be further reduced without endangering system availability.

Figures 2A, 2B:
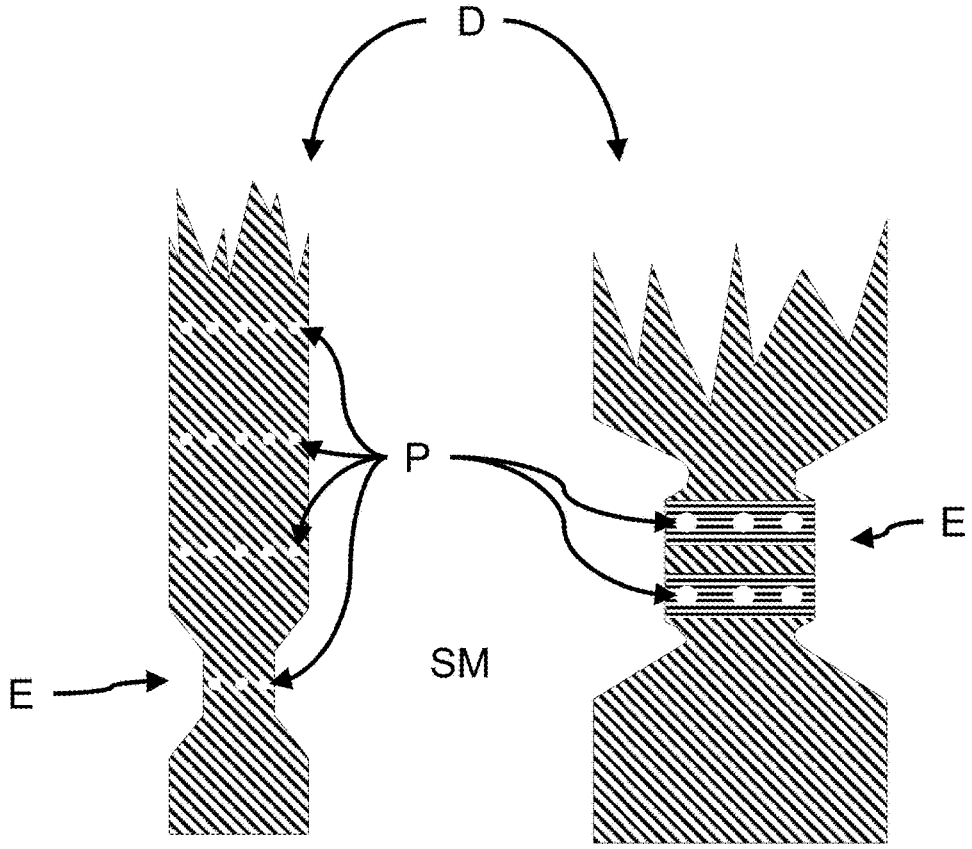
FIG. 2*a* shows one aspect of the invention.
FIG. 2*b* shows another aspect of the invention.

In one advantageous embodiment, which is shown in FIGS. 2*a* and 2*b*, the fuse element has, at least in the proximity of the constriction E—as shown in FIG. 2*a*—a perforation (or row of perforations) P or—as shown in FIG. 2*b*—several perforations (or rows of perforations) P. Suitable perforations can of course also be arranged in other locations on the fuse element D, as can be seen from FIG. 2*a*, for example. The structure of the perforation P is circular only for the sake of example. It can also take other shapes.

It is particularly advantageous if the constriction E has a perforation in which the fluxing agent SM is located. The process of diffusion into the fuse element D can thus be accelerated. The diffusion causes the electrical resistance to change (increase), thereby increasing local heat transformation and promoting prompt disconnection.

In FIG. 1, the voltage-sensitive element is shown as a transient voltage suppressor diode (TVS). However, the invention is not limited to this, and any type of voltage-sensitive element can be used, particularly including any other electrical/electronic components, such as a thermistor (e.g., a negative temperature coefficient thermistor (NTC) or a positive temperature coefficient thermistor (PTC)), a suppressor diode, a gas discharge tube, or even bimetallic switches. Of course, these elements can also be provided in any suitable parallel or series connection.

Figure 3:
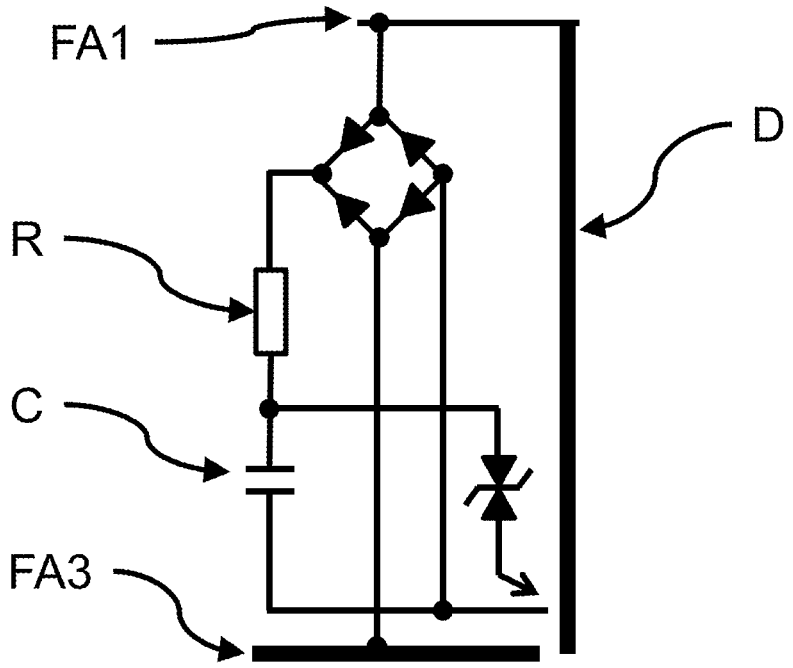
FIG. 3 shows yet another aspect of the invention.

Another aspect of the invention is illustrated in FIG. 3. Here, in addition to the internal switch element TVS, a time-delay device is integrated (dead time) that is provided in relation to the internal switch element TVS, for example through lowpass-forming elements such as a resistor R and a capacitor C.

Using this, it is possible, for example, to absorb load peaks resulting from engine startup or the charging of capacitative loads; that is, the currents subside enough during the dead time that the trigger condition is no longer present.

Preferably, the load current-bearing fuse 1 is arranged in a pressure-tight and/or insulating housing.

In the event of small short-circuit currents, ignition is possible between the third contact FA3 and the fuse element D, but the electric arc that then burns may be unstable. That is, a case may arise in which the electric arc is quenched without the fuse element having been completely interrupted.

The fuse element is then often partially fused only in a subregion, namely the portion that is closest to the third contact FA3—i.e., generally at the constriction E. More distant areas are intact, since the electric arc cannot burn stably to those points due to the increasing length.

Particularly in the case of alternating-current networks, this behavior can be explained by the fact that, at low short-circuit current values, the energy required to fuse the fuse element D cannot be mustered within a half-wave.

In order to enable more stable burning of the electric arc, particularly with alternating current as well, a planar convergence of the fuse element D to the third contact FA3 is proposed. This ensures initially that a defined distance exists between the fuse element D and the third contact FA3 over the entire width of the fuse element D.

Figure 4:
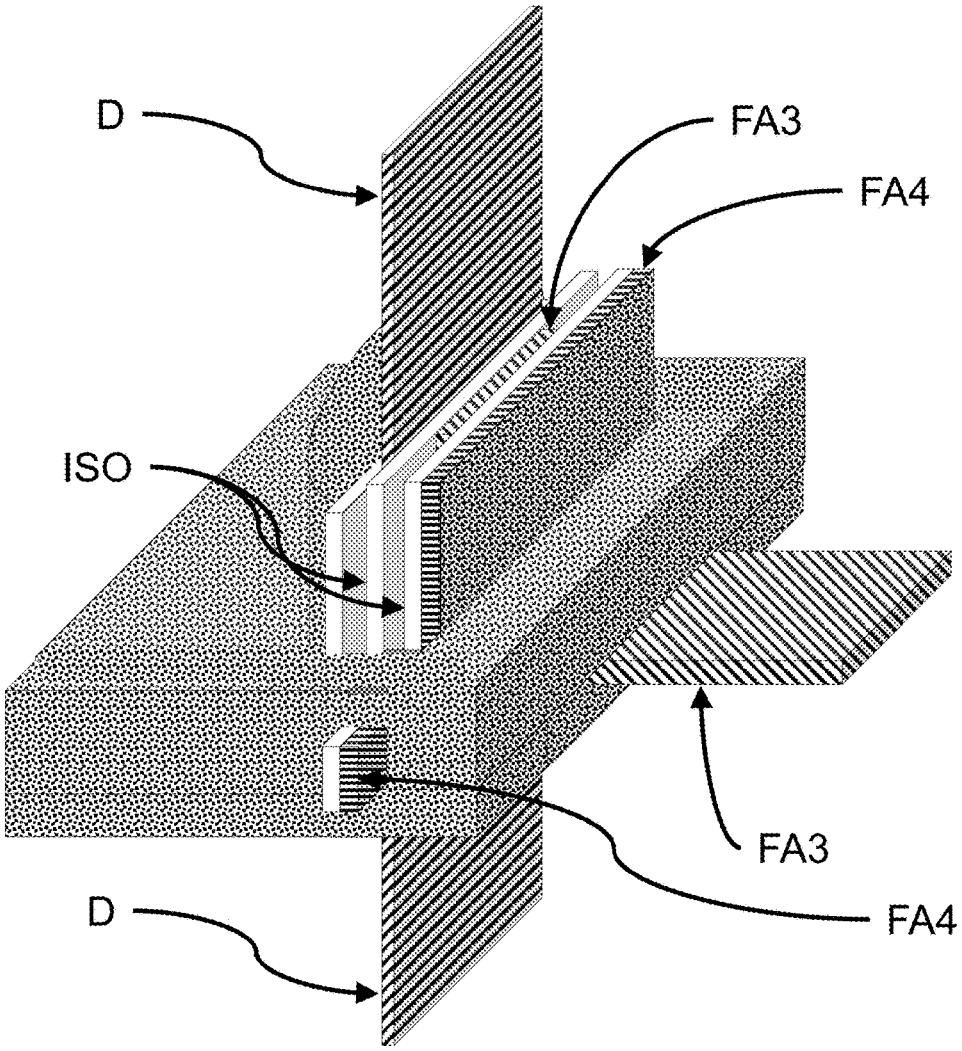
FIG. 4 shows an exemplary configuration of contacts and fuse elements according to embodiments of the invention.

Another aspect in this regard according to one embodiment is illustrated in FIG. 4.

Here, the fuse element D and the third contact FA3 of the fuse element F are electrically separated in the normal operating state by an insulating material ISO, with the third contact FA3 and the insulating material ISO being arranged such that an ignition near the insulating material ISO results in an at least superficial degradation of the insulating material ISO, whereby the surface loses its insulating property and allows current to flow between the fuse element D and the third contact FA3.

The fuse element D (shown with longitudinal hatching) is shown without constriction E. The fuse element D is separated from the third contact FA3 (shown with diagonal hatching) by an insulating material ISO (shown as a white layer). Moreover, a fourth contact FA4 (shown with cross-hatching) is provided, with it being possible for the third contact and the fourth contact FA4 to be separated by a (similar or different) insulating material ISO. The sequence of the fourth contact FA4 and the third contact FA3 can also be set up differently; that is, the fourth contact FA4 can also be arranged adjacent to the fuse element D. The different contacts FA3, FA4 and the fuse element D can be manufactured as thin metal films or plates, for example. The various elements can be contained inside an insulating enclosure (shown as a dotted line).

In the event of triggering by means of the third contact FA3 or fourth contact FA4 (if present), an electric arc occurs toward the fuse element D that damages the insulating material ISO located nearby (between D and FA3), so that the insulating material ISO, due to its low CTI value (CTI value of FR4 of about 150 V, for example) and the (local superficial) degradation caused by the electric arc (for example, sooting, charring), now causes a (small) electric arc to continue to be maintained (or ignited again after a zero point of the phase in the case of alternating voltage operation as well), which "eats" its way starting from the point of origin along the boundary surface (in both directions), thereby ultimately severing the fuse element D.

Even though an ignition between FA4 and FA3 is assumed here, any ignition—i.e., an ignition from FA4 to the fuse element D as well—can result in a commensurate (superficial) degradation of the (previously) insulating material ISO.

The insulating material ISO can have a plastic or a composite material with a low CTI value, for example phenol resin (PF resins), polyether ether ketone (PEEK), polyimide (PI), or epoxy resin-filled glass fiber composite materials such as FR4 or the like. CTI values—also known as tracking resistance—are determined according to IEC 60112, for example. Exemplary materials are classified under insulator group IIIa and/or insulator group IIIb.

LIST OF REFERENCE SYMBOLS

| | |
|---|---|
| load current-bearing fuse | 1 |
| device to be protected | Z |
| protective element | F |
| device contact | ZA1, ZA2 |
| protective element contact | FA1, FA2, FA3, FA4 |
| potential | L, N |
| fuse element | D |
| constriction | E |
| fluxing agent | SM |
| overvoltage-sensitive element | TVS |
| insulating material | ISO |

The invention claimed is:

1. A load current-bearing fuse with internal switch element having a protective element, wherein the protective element has a first contact for connecting to a first potential of a supply network and a second contact that configured to be connected via a device to be protected to a second potential of the supply network, wherein the protective element has at least one fuse element that connects the first contact and the second contact, wherein the protective element has a third contact configured to be connected to the second potential of the supply network and is arranged so as to be near to, but electrically insulated from, the fuse element, wherein the fuse element has a constriction in the proximity of the third contact, with the constriction being embodied such that the fuse element has an electrically conductive fluxing agent in the proximity of the constriction, wherein the fluxing agent has a lower fusion point than the fuse element itself, wherein the load current-bearing fuse further comprises an internal switch element that monitors the protective element internally and provides a targeted disconnection, with the internal switch element being a voltage-sensitive element that is connected with one contact to the first contact, and wherein the other contact of the voltage-sensitive element is electrically insulated from the fuse element and near to but electrically insulated from the third contact.

2. The load current-bearing fuse as set forth in claim 1, wherein the constriction has a perforation in which the fluxing agent is located.

3. The load current-bearing fuse as set forth in claim 1, wherein the internal switch element is a voltage-switching element or a bimetallic switch, or a thermistor, a suppressor diode, or a gas discharge tube.

4. The load current-bearing fuse as set forth in claim 3, wherein in addition to the internal switch element, a time-delaying device is provided in relation to the voltage-sensitive element by low pass-forming elements.

5. The load current-bearing fuse as set forth in claim 1, wherein the internal switch element is arranged in a pressure-tight housing.

6. The load current-bearing fuse as set forth in claim 1, wherein the fuse element and the third contact are electrically separated in the normal operating state by an insulating material, in which case the third contact and the insulating material are arranged such that an ignition near the insulating material results in an at least superficial degradation of the insulating material, whereby a surface of the insulating material loses its insulating property and allows current to flow between the fuse element and the third contact.

7. The load current-bearing fuse as set forth in claim 6, wherein the insulating material comprising: a plastic or a composite material with a low CTI value, for example polyether ether ketone, polyimide, or epoxy resin-filled glass fiber composite materials such as FR4.

* * * * *